US007107979B2

(12) United States Patent
Mitchell

(10) Patent No.: US 7,107,979 B2
(45) Date of Patent: Sep. 19, 2006

(54) SLING SHOT BLOW GUN COMBINATION DEVICE

(76) Inventor: Edward Mitchell, 1340 Gault Way, Sparks, NV (US) 89431

( * ) Notice: Subject to any disclaimer, the term of this patent is extended or adjusted under 35 U.S.C. 154(b) by 0 days.

(21) Appl. No.: 10/789,270

(22) Filed: Feb. 28, 2004

(65) Prior Publication Data

US 2006/0180133 A1 Aug. 17, 2006

(51) Int. Cl.
*F41B 3/02* (2006.01)
*F41B 1/00* (2006.01)

(52) U.S. Cl. ..... 124/20.1; 124/62

(58) Field of Classification Search ..... 124/20.1, 124/20.3, 25, 62
See application file for complete search history.

(56) References Cited

U.S. PATENT DOCUMENTS

| | | | | | |
|---|---|---|---|---|---|
| 2,625,926 | A | * | 1/1953 | Foster | 124/20.1 |
| 2,667,863 | A | * | 2/1954 | Styles | 124/20.1 |
| 3,415,239 | A | * | 12/1968 | Swett | 124/20.3 |
| 3,949,729 | A | * | 4/1976 | Pfotenhauer | 124/20.3 |
| 4,593,673 | A | * | 6/1986 | Kees | 124/20.3 |
| 4,852,543 | A | * | 8/1989 | Mosser | 124/20.1 |
| 5,016,601 | A | * | 5/1991 | Ferguson et al. | 124/20.1 |
| 5,437,260 | A | * | 8/1995 | King | 124/25 |
| 5,551,412 | A | * | 9/1996 | Warnke | 124/20.1 |

* cited by examiner

*Primary Examiner*—John A. Ricci
(74) *Attorney, Agent, or Firm*—Robert Ryan Morishita; Morishita Law Firm, LLC

(57) ABSTRACT

A unique human powered weapon for hunting or target shooting combining a sling shot, an arrow shooting device and a blow gun with sights and collapsability.

5 Claims, 3 Drawing Sheets

SLING SHOT BLOW GUN COMBINATION DEVICE

BACKGROUND

1. Field of Invention

This invention relates generally to the field of manually operated weapons.

2. Description of the Prior Art

The prior art includes blow guns dating back hundreds of years. Modern materials have been used for the basic tube approach; however, sights and collapsability have never been provided until now.

Further, the Applicant's invention is the first to provide a combination with sling shot. Applicant's sling shot provides a sight and a long sight radius for high accuracy. Applicant's invention further provides means to rest the weapon on a shoulder for a more accurate hold.

DETAILED DESCRIPTION OF PREFERRED EMBODIMENTS

Figure 1:
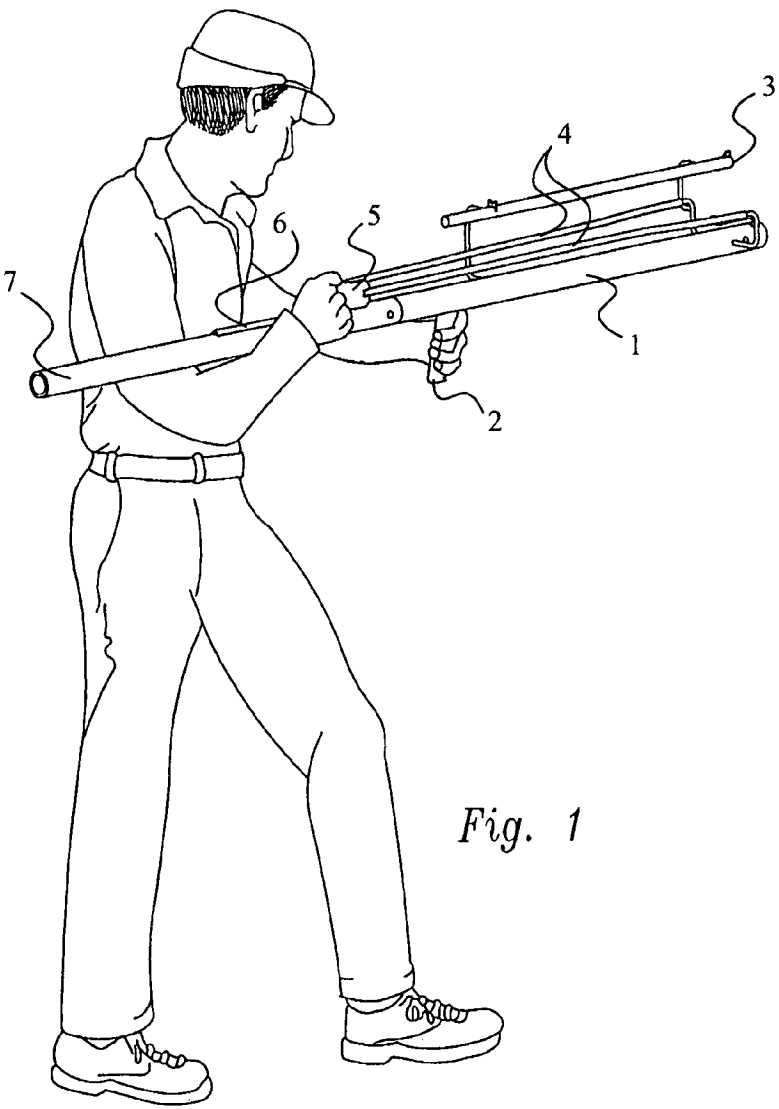
FIG. 1 Perspective view of blow gun in situ.

FIG. 1 shows the sling shot having a structural member 1 with a handle 2. The device has a sight bar 3 and elastic members 4 attached together at a pouch 5. The pouch with a projectile is drawn along a rail 6 to extend the elastic members 4 which stored energy will launch the projectile when released. The invention also has an extension 7 which permits a solid hold of the weapon. Note that the sight rod 3 is offset to clear the elastic members 4 but align with their point of aim.

Figure 2:
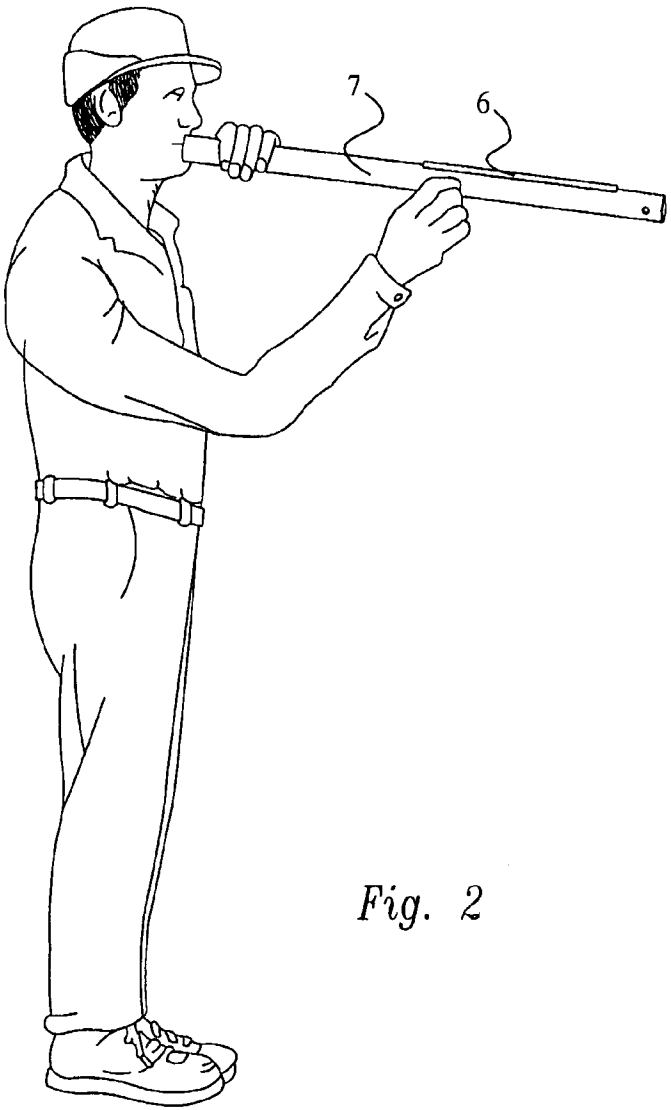
FIG. 2 Perspective view of sling shot orientation.

FIG. 2 shows the extension 7 can be operated as blow gun. The rail 6 can be used as a sight in this configuration.

Figure 3:
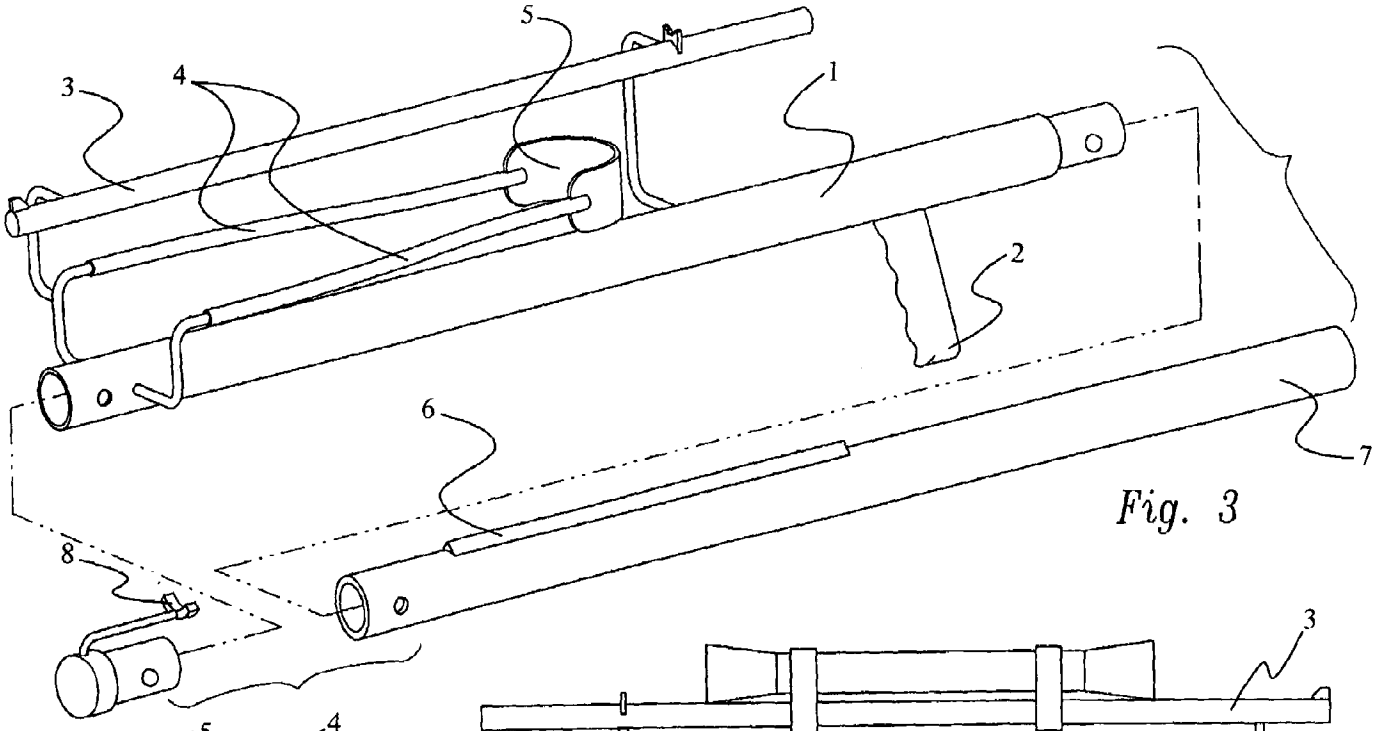
FIG. 3 Exploded view of device.
Figure 4:
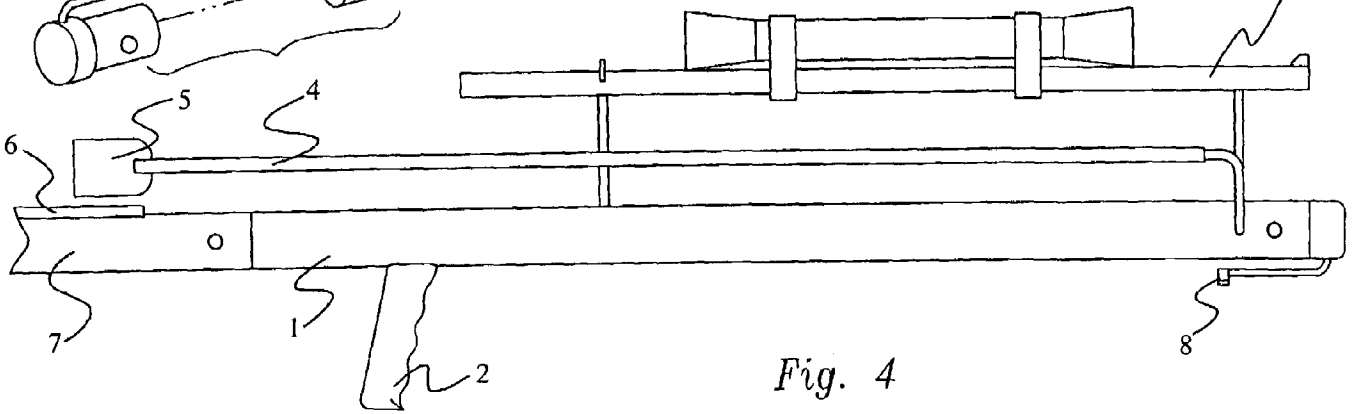
FIG. 4 Side view of device.
Figure 5:
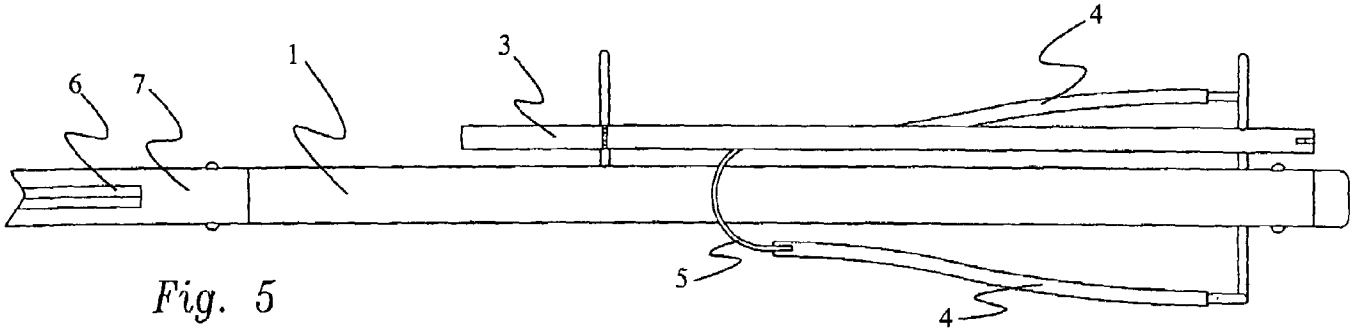
FIG. 5 Top view of device.
Figure 6:
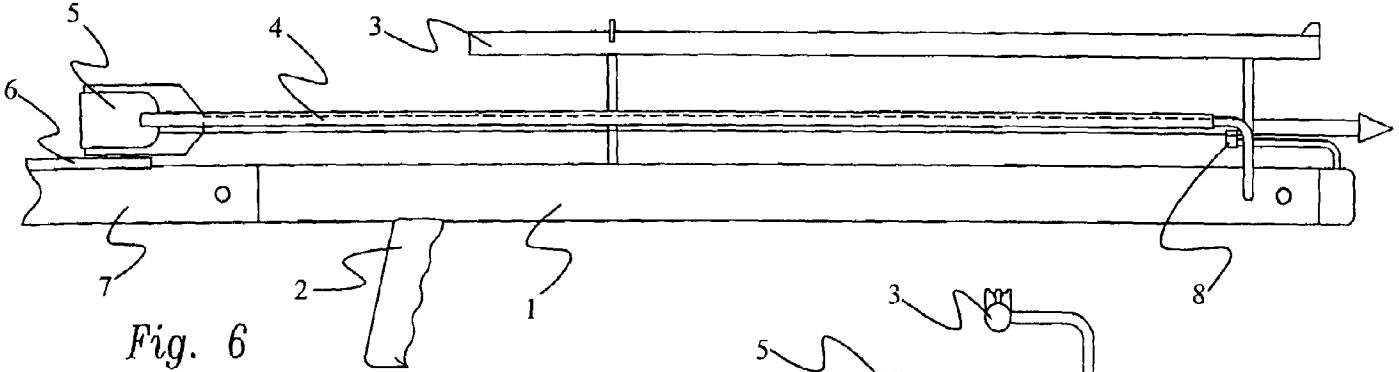
FIG. 6 Opposite side view of device.
Figure 8:
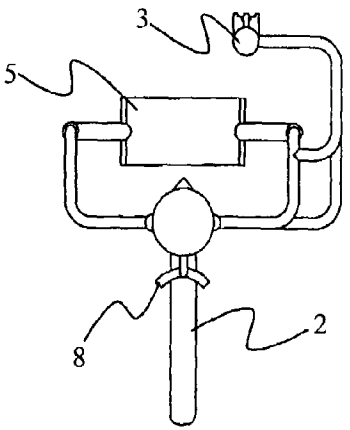
FIG. 8 Front view of device.
Figure 7:
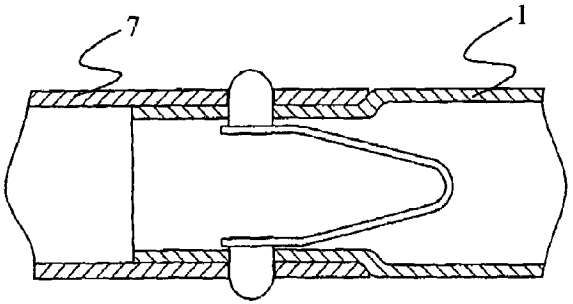
FIG. 7 Sectional view of attachment.

FIG. 3 shows an exploded view of the device. It further shows, along with FIG. 7, the button snap fitting mechanism for releasable attachment of members 1 and 7. FIG. 3 also shows an arrow support 8 which can be fitted into the end of member 1 and has a place to support an arrow shaft, the tail of which can be held in the pouch 5 and the sling becomes a compact arrow launcher. The arrow support member is button snap attached and therefore can be rotated out of the way as shown in FIG. 4 or used as shown in FIG. 6 with an arrow. FIG. 8 shows the business end of the device.

The device can be made of plastics, nylons, or aluminum, even titanium or alloys of light weight, strong material. The rail can be any material that will provide a low friction contact for the pouch. The pouch material should be a strong fabric like canvas or the like; alternatively leather or tent weave nylons or acetates will work. The elastic materials 4 and the pouch may be a single unit of the same material.

Obviously, numerous (additional) modifications and variations of the present invention are possible in light of the above teachings. It is, therefore, to be understood that the invention may be practiced otherwise than as specifically described herein.

The invention claimed is:

1. A sling shot comprising:

a structural member having a front and a rear;

at least one elastic member supported by said structural member, said elastic member storing elastic energy to launch a projectile when drawn and converting said elastic energy the kinetic energy when released;

a pouch attached to said elastic member for holding a projectile such that when said elastic member is released said kinetic energy launches said projectile;

a sight rod attached to said structural member for aiming said projectile; and a shoulder rest for supporting said structural member, said shoulder rest attached to said rear of said structural member with said front of said structural member directed toward a target, said shoulder rest including a extension tube releasably attached to said structural member, said extension tube including a hollow tube with passage therethrough for receiving a projectile such that said extension tube is adapted to function as a blow gun.

2. A device as described in claim 1 wherein said sight rod comprises bar mounted parallel to, and spaced from, said structure member.

3. A device as described in claim 1 wherein said sling shot further comprises an arrow rest mounted to said structural member and aligned with said elastic member, such that an arrow having two ends may be rested on said arrow rest with one end of said arrow in said pouch and the other end of said arrow directed toward a target whereby the arrow may be launched by said elastic member.

4. A device as described in claim 1 further comprising a rail mounted on said extension tube aligned with said elastic member, such that said pouch moves along said rail when said elastic member is drawn.

5. A device as described in claim 1 further comprising a handle extending substantially perpendicular to said structural member.

* * * * *